US005787806A

United States Patent [19]

Seyfried

[11] Patent Number: 5,787,806

[45] Date of Patent: Aug. 4, 1998

[54] ELECTRIC MOTOR SPEED CONTROL

[75] Inventor: Rüdiger Karl Seyfried, Zell/Main, Germany

[73] Assignee: Koenig & Bauer-Albert Aktiengesellschaft, Wurzburg, Germany

[21] Appl. No.: 731,010

[22] Filed: Oct. 9, 1996

[30] Foreign Application Priority Data

Oct. 9, 1995 [DE] Germany ..... 195 37 587.4

[51] Int. Cl.[6] ..... B41F 5/00

[52] U.S. Cl. ..... 101/181; 101/216; 101/248

[58] Field of Search ..... 101/181, 183, 101/248, 216; 318/39, 49, 77, 85, 111

[56] References Cited

U.S. PATENT DOCUMENTS

| | | | |
|---|---|---|---|
| 4,724,763 | 2/1988 | Bolza-Schunemann et al. | 101/181 |
| 4,761,597 | 8/1988 | Sasaki et al. | 318/85 |
| 4,898,094 | 2/1990 | Doumoto et al. | 101/181 |
| 5,049,798 | 9/1991 | Jackson | 318/85 |
| 5,309,834 | 5/1994 | Koch | 101/248 |
| 5,386,772 | 2/1995 | Tolle et al. | 101/181 |
| 5,415,093 | 5/1995 | Numauchi | 101/248 |

FOREIGN PATENT DOCUMENTS

| | | | |
|---|---|---|---|
| 41 32 765 | 4/1993 | Germany | 101/181 |
| 42 14 394 | 11/1993 | Germany | 101/181 |
| 58-110110 | 6/1983 | Japan | 101/181 |
| 1-92495 | 4/1989 | Japan | 101/181 |

OTHER PUBLICATIONS

"Siemens–Zeitschrift"; Meyer et al.; 1977; pp. 387–399.

*Primary Examiner*—Edgar S. Burr
*Assistant Examiner*—Steven S. Kelley
*Attorney, Agent, or Firm*—Jones, Tuller & Cooper, P.C.

[57] ABSTRACT

A speed control device for a multi-motor drive mechanism for driving printing press components is described. The speed control device allows the control of drive motors experiencing different instantaneous loads. This is achieved in accordance with the invention by assigning the motor having the greatest load fluctuation as the master, with the other motors assigned as slaves. A signal indicative of the demand experienced by the master is smoothed and used to control the slave motors.

5 Claims, 1 Drawing Sheet

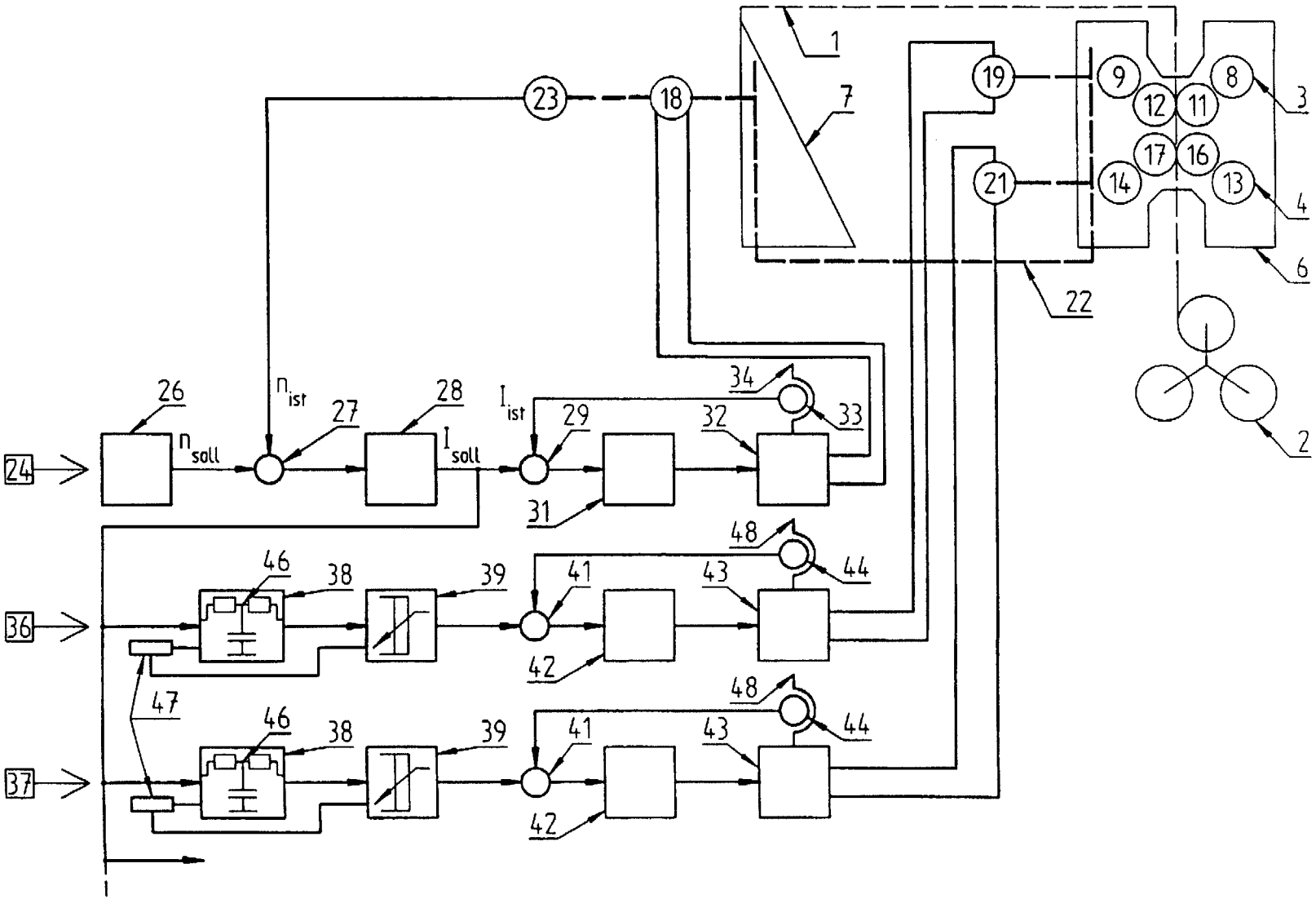
1
2
3
4
6
7
8
9
11
12
13
14
16
17
18
19
21
22
23
24
26
27
28
29
31
32
33
34
36
37
38
39
41
42
43
44
46
47
48
$n_{ist}$
$n_{soll}$
$I_{ist}$
$I_{soll}$

ELECTRIC MOTOR SPEED CONTROL

FIELD OF THE INVENTION

The present invention is directed generally to an electric motor speed control. More particularly, the present invention is directed to a speed control device for a multi-motor drive mechanism. Most specifically, the present invention is directed to a speed control device for a multi-motor drive mechanism for driving the components of a printing press. At least one interlocking drive device is provided with at least two electric motors. One of these electric motors, which is provided with a master control system, is utilized as the master drive motor. The other electric motors are also provided with slave control systems and are utilized as slave electric motors. The slave control systems respond to a current value obtained from the master control system. The current value is derived from a speed control device which measures the speed of the master drive motor.

DESCRIPTION OF THE PRIOR ART

In the field of printing, it is generally known to utilize a plurality of individual electric motors to drive various printing press components. These individual electric motors must all be controlled in some type of interrelated or interdependent manner in order for the printing press to operate properly. Clearly if the individual electric drive motors do not operate in a controlled manner, the printing press will not operate properly and the result will be a poorly printed produce.

One speed control device for use in a multi-motor drive mechanism of a printing press is disclosed in the German Patent Publication DE 41 32 675 A1. A master drive motor, with its own control system, is disposed in this speed control device. Each other motor in this multi-motor drive mechanism has its own control system. These control systems are formed by the control system of the master drive motor.

In the German Patent Publication DE 42 14 394 A1 there is described a rotary printing press with individual drive mechanisms. The individual drive mechanisms of the groups of printing stations receive their reference positions from the folding apparatus.

An article in volume 51 of the "Siemens-Zeitschrift", in issue 5 at pages 387 to 398 describes a multi-motor drive mechanism for use in rotary printing presses. As may be seen in FIG. 4 of this article, a filter is used in conjunction with a register adjustment device. The structure of this adjustment device is not based on an arrangement of connected drive mechanisms.

It will be seen that a need exists for a speed control device which overcomes the limitations of the prior art. The electric motor speed control in accordance with the present invention provides such a device and is a significant improvement over the prior art.

SUMMARY OF THE INVENTION

It is an object of the present invention to provide an electric motor speed control.

Another object of the present invention is to provide a speed control device for a multiple motor drive mechanism.

A further object of the present invention is to provide a speed control device for a multi-motor drive mechanism for driving the components of a printing press.

Still another object of the present invention is to provide a speed control device for a multi-motor drive mechanism in which it is possible to control the drive motors of various components having momentarily varying loads.

As will be set forth in detail in the description of the preferred embodiment which is presented subsequently, the electric motor speed control device in accordance with the present invention is usable to control the multiple drive motors driving the various components of a printing press. At least one interlocking drive mechanism of the printing press has at least two electric drive motors. One of these motors is provided with a master control system and is utilized as the master drive motor. Each of the other electric motors is also provided with a control system and these motors are operated as slave electric motors. The control systems of the slave electric motors receive a current set value from the control system of the master electric motor. This current set value is formed in a master electric motor speed control device. The master drive motor is the motor that is used to drive the component of the printing press which has the greatest fluctuation in momentary load values.

A filter is provided in the control systems for the slave electric motors. This filter smooths the current set value supplied to the slave electric motor control systems from the current set value that is supplied to the master motor control system. As was mentioned previously, this current set value is formed in a master electric motor speed control device.

The electric motor speed control device in accordance with the present invention is used in a multi-motor drive mechanism for a printing press to control the press component which is apt to cause the greatest momentary fluctuations. Such a component is apt to be a folding apparatus which, in the present invention, is driven by a drive motor whose control system reacts quickly to this widely fluctuating demand in order that an even rotational speed of the folder drive motor will be provided. This drive motor for the press component having the widely fluctuating momentary values, will be used as the master drive mechanism. At the same time, other components of the printing press, which have less widely fluctuating momentary values, such as is particularly the case with printing units, will be driven by electric drive motors whose control systems are adapted to respond to a smoothed version of the widely fluctuating momentary values. These other components are thus not caused to have wide fluctuations in response to the wide fluctuations that are in existence in the control assembly of the master drive mechanism.

One advantage of the electric motor speed control in accordance with the present invention is that it is possible to weigh the slaved drive members with a proportionality factor so that the impact of defined ones of the various slaved electric motors on the multiple motor drive mechanism can be defined as positive or negative loads. In this way, a clear instantaneous flow direction within the printing machine is defined, even in the event of changing load behavior on the printing machine. Various printing or other problems caused by speed or load fluctuation variations, such as register offset caused by changes in tooth profile, or play in a driveshaft, are prevented.

The electric motor speed control device in accordance with the present invention overcomes the limitations of the prior art. It is a substantial advance in the art.

BRIEF DESCRIPTION OF THE DRAWING

While the novel features of the electric motor speed control in accordance with the present invention are set forth with particularity in the appended claims, a full and complete understanding of the invention may be had by referring to the detailed description of the preferred embodiment which is presented subsequently, and as illustrated in the accompanying sole drawing FIGURE which is a schematic depiction of an electric motor speed control arrangement for a printing press in accordance with the present invention.

DETAILED DESCRIPTION OF THE PREFERRED EMBODIMENT

Referring to the sole drawing FIGURE, a printing press, for example, in a preferred embodiment, a web-fed rotary printing press, processes a web 1. The press consists of a roller stand 2 which holds a plurality of rolls of paper to be printed, an H-shaped printing unit 6 formed by two bridge printing groups 3 and 4 and a folding apparatus 7. Each of the two bridge printing groups 3 and 4 is comprised of printing and rubber blanket cylinders 8, 9, 11, 12 and 13, 14, 16, 17, connected with each other by means of a positive drive mechanism, i.e. an interlocking drive mechanism such as a toothed gear train.

The folding apparatus 7 and the two bridge printing groups 3, 4 are each driven by their own electric motors 18, 19, 21, and are positively connected with each other in a synchronized, interlocking manner by means of a positive drive mechanism 22, which, for example, can be a drive-shaft. The electric motors 18, 19, 20 can be embodied as dc or three-phase ac motors. In the exemplary embodiment, dc motors are described. When using three-phase ac motors, the values corresponding to voltages are used for control. This web-fed rotary printing press can, of course, also be comprised of a plurality of printing units, also of different types. For example, the units may be constructed in series, and can include several folding devices.

The drive motor 18 of the components experiencing the greatest momentary fluctuation, which in the instant example is the drive motor 18 of the folding apparatus 7, is provided as a master drive motor 18. The drive motor 18 is provided with an rpm pick-up 23.

A control system 24 is placed upstream of the master drive motor 18. This control system 24 consists of an rpm set point adjuster 26, an rpm summation point 27, an rpm regulator 28, a current summation point 29, a current regulator 31, an output power element 32 and an actual current sensor 33. The rpm set point adjuster 26 is connected with the first input of the rpm summation point 27 and the rpm pick-up 23 with the second input. The output of the rpm summation point 27 is conducted via the rpm regulator 28 to a first input of the current summation point 29. The second input of the current summation point 29 is connected with the actual current sensor 33 of the master drive motor 18, which is disposed in a current supply line 34. The output of the current summation point 29 is connected with the master drive motor 18 via the current regulator 31 and the output power element 32 connected downstream thereof.

Additional control systems 36 and 37 are respectively connected upstream of the two slaved drive motors 19 and 21 of the bridge printing groups 3 and 4 and other possible additionally disposed drive motors. The control systems 36 and 37 each consists of a current set point adjuster 38, a current level adapter 39, a current summation point 41, a current regulator 42, an output power element 43 and an actual current sensor 44. The current set point adjuster 38, which is located downstream of the rpm regulator 28, is provided with a filter 46 for smoothing the current set value. The filter 46 for smoothing the actual current value is preferably designed as a low-pass filter (for example an RC component or an LC circuit). The current level adapter 39 is connected downstream of this current set point adjuster 38 and leads to a first input of the current summation point 41. The filter 46 and the current level adaptation 39 can be parameterized via an input station 47. The second input of the current summation point 41 is in turn connected with the actual current sensor 44, disposed in a current supply line 48, of the respective slaved drive motor 19, 21. The output of this current summation point 41 is connected via the current regulator 42 and the downstream connected output power element 43 to the respective slaved drive motor 19, 21.

The mode of functioning of the speed regulating device for a multi-motor drive mechanism in accordance with the invention is as follows:

An rpm set value $n_{SOLL}$ is entered in the rpm summation point 27 by means of the rpm set point adjuster 26. There, the rpm set value $n_{SOLL}$ is compared with the actual rpm value $n_{IST}$ detected by the rpm pick-up 23. A signal representative of the difference between these two values is provided to the rpm regulator 28. At its output, the rpm regulator 28 determines a current set value $I_{SOLL}$, which is supplied to the current summation point 29 of the master drive motor 18 as well as to the current set point adjuster 38 of the control system 36, 37 of each slaved drive motor 19, 21. The current set value $I_{SOLL}$ of the master drive motor 18 detected by the actual current sensor 33. A signal representative of the difference between these two values is supplied to the current regulator 31. The current regulator 31 controls the master drive motor 18 by means of the output power element 32.

The control systems 36 and 37 of the respective slaved drive motors 19 and 21 receive the current set value $I_{SOLL}$ from the output of the rpm regulator 28, which is supplied to the current set point adapter 38. This current set value $I_{SOLL}$ of the master drive motor 18 is smoothed in the current set point adapter 38, and by means of the level adapter 39 a current set value for the salved drive motors 19 and 21 is supplied to a first input of the current summation point 41. There, an actual current value of the slaved drive motor 19, 21 detected by the actual current sensor 44 is compared with the actual current value. A signal representative of the difference between these two values is supplied to the current regulator 42, which controls the slaved drive motors 19 and 21 by means of the output power element 43.

Although a preferred embodiment has been described, rather than assign each component 3, 4 and 7 its own electric motor 18, 19 and 21, it is possible instead to only assign two of electric motors 18, 19 or 21 to all components 3, 4 and 7 having interlocking drive mechanism. Thus, each interconnected drive train may be driven by at least two electric motors 18, 19 or 21, a master 18 and at least one slave 19 or 21.

It is also possible to arrange two electric motors 18, 19 or 21 within one unit enclosing 3, 4 and 7. It is common to all embodiments that two motors are provided for one interconnected drive mechanism 22 (also within a print unit). This drive mechanism 22 can also consist of toothed wheels which interlockingly connect the cylinders 8, 9, 11, 12 and 13, 14, 16, 17 of a bridge printing group 3 and 4 with each other.

While a preferred embodiment of an electric motor speed control in accordance with the present invention has been set forth fully and completely hereinabove, it will be apparent to one of skill in the art that a number of changes could be made without departing from the true spirit and scope of the present invention. For example, filter 46 can be designed as an active filter using, for example, operational amplifiers and LC or RC circuits, or as a passive filter using, for example, RC or LC components. In addition, filter 46 can be implemented as a digital filter. Thus, the present invention is accordingly to be limited only by the following claims.

What is claimed is:

1. A system for controlling a printing press having at least two printing units, said printing units experiencing different loads affecting a printing press operating point, said system comprising:

an interlocking drive mechanism connecting said printing units;

a master motor for driving a first of said printing units;

a speed control for deriving a current set signal in response to said loads experienced by said printing units, said speed control including:

an rpm pick-up for outputting a master motor actual rpm signal indicative of master motor rpm;

an rpm set-point adjuster for outputting a master motor desired rpm signal;

an rpm summation point for comparing said master motor actual and desired rpm signals to output an rpm difference signal; and an rpm regulator for outputting said current set signal in response to said rpm difference signal;

a master motor control system for controlling said master motor in response to said current set signal;

at least one slave motor for driving at least a second of said printing units; and a slave motor control system including a filter responsive to said current set signal for outputting a filtered set signal for controlling said slave motor.

2. A system for controlling a printing press having at least two printing units, said printing units experiencing different loads affecting a printing press operating point, said system comprising:

an interlocking drive mechanism connecting said printing units;

a master motor for driving a first of said printing units;

a speed control for deriving a current set signal in response to said loads experienced by said printing units;

a master motor control system for controlling said master motor in response to said current set signal, said master motor control system including:

a current sensor which senses master motor current and in response, outputs an actual motor current signal;

a current summation point which compares said actual motor current signal and said current set signal and in response, outputs a current difference signal;

a current regulator which outputs a regulated master motor control signal in response to said current difference signal; and an output power element for driving said master motor in response to said regulated master control signal;

at least one slave motor for driving at least a second of said printing units; and a slave motor control system including a filter responsive to said current set signal for outputting a filtered set signal for controlling said slave motor.

3. A system for controlling a printing press having at least two printing units, said printing units experiencing different loads affecting a printing press operating point, said system comprising:

an interlocking drive mechanism connecting said printing units;

a master motor for driving a first of said printing units;

a speed control for deriving a current set signal in response to said loads experienced by said printing units;

a master motor control system for controlling said master motor in response to said current signal;

at least one slave motor for driving at least a second of said printing units; and a slave motor control system including a filter responsive to said current set signal for outputting a filtered set signal for controlling said slave motor, said slave motor control system further comprising:

an input station for setting paramaterizing control signals for said slave motor control system;

a current set point adjuster responsive to said paramaterizing control signals and said current set signal to output said filtered set signals;

a current level adapter responsive to said filtered set signal and to said paramaterizing control signals to output a slave current set signal;

a current sensor which senses slave motor current and in response outputs an actual slave motor current signal;

a current summation point which compares said actual slave motor current signal and said slave current set signal and in response, outputs a slave current difference signal;

a current regulator which outputs a regulated slave motor control signal in response to said slave current difference signal; and an output power element for driving said slave motor in response to said regulated slave control signal.

4. A system for controlling a plurality of mechanically coupled units of a printing press, comprising:

a master motor for driving a first of said printing units, said first printing unit experiencing the greatest load fluctuation of any of said printing units;

a speed control including an rpm regulator for generating a current set signal in response to said loads experienced by said printing units;

a master motor control system for controlling said master motor in response to said current set signal;

at least one slave motor for driving at least a second of said printing units; and a slave motor control system for outputting a set signal for controlling said slave motor, said slave motor control system comprising:

a filter for smoothing said current set signal generated by said rpm regulator, and thereby generating a smoothed set signal; and a current regulator responsive to said smoothed set signal for outputting a regulated slave motor control signal for controlling said slave motor.

5. The system of claim 4, wherein said speed control further comprises an rpm sensor for sensing the rotational speed of said master motor.

* * * * *